US006457227B1

(12) United States Patent
Nijveld et al.

(10) Patent No.: US 6,457,227 B1
(45) Date of Patent: Oct. 1, 2002

(54) DEVICE AND PROCESS FOR PRODUCING A STEEL STRIP

(75) Inventors: Erik Marco Nijveld, Haarlem (NL); Simon Petrus Anthonium Zuurbier, Castricum (NL)

(73) Assignee: Corus Staal BV, CA IJmuiden (NL)

( * ) Notice: Subject to any disclaimer, the term of this patent is extended or adjusted under 35 U.S.C. 154(b) by 0 days.

(21) Appl. No.: 09/555,457

(22) PCT Filed: Dec. 8, 1998

(86) PCT No.: PCT/NL98/00698

§ 371 (c)(1),
(2), (4) Date: Jul. 20, 2000

(87) PCT Pub. No.: WO99/29445

PCT Pub. Date: Jun. 17, 1999

(30) Foreign Application Priority Data

Dec. 8, 1997 (NL) ..... 1007730

(51) Int. Cl.[7] ..... B21B 1/46

(52) U.S. Cl. ..... 29/527.7; 29/33 B; 29/33 C; 228/5.7

(58) Field of Search ..... 29/527.7, 33 C, 29/33 B; 228/5.7, 17

(56) References Cited

U.S. PATENT DOCUMENTS 5,490,315 A 2/1996 Kostopolos et al. ..... 29/527.7
6,280,542 B1 8/2001 Cornelissen et al.

FOREIGN PATENT DOCUMENTS

| | | |
|---|---|---|
| CA | 2221423 | * 5/1998 |
| EP | 0306076 | 3/1989 |
| EP | 0460655 | 12/1991 |
| EP | 0593001 | 4/1994 |
| EP | 0795361 | 9/1997 |
| EP | 0845308 | 3/1998 |
| FR | 1125304 | 10/1956 |
| WO | 9746332 | 12/1997 |

OTHER PUBLICATIONS

Patent Abstracts of Japan, vol. 006, No. 199, Oct. 8, 1982 & JP 57 106403, published Jul. 2, 1982.

Patent Abstracts of Japan, vol. 012, No. 286, Aug. 5, 1988 & JP 63 063502, published Mar. 19, 1988.

* cited by examiner

*Primary Examiner*—P. W. Echols
(74) *Attorney, Agent, or Firm*—Stevens, Davis, Miller & Mosher, LLP

(57) ABSTRACT

A device for producing a thin steel strip, comprising at least one or more continuous-casting machines (1) for casting thin steel slabs, a furnace device (7) which is suitable for heating and/or homogenizing a slab, and at least one rolling device for reducing the thickness of a slab which is conveyed out of the furnace device (7), a welding machine being arranged between the continuous-casting machine (1) or continuous-casting machines (1) and the rolling device (10), for the purpose of joining slabs together.

24 Claims, 3 Drawing Sheets

DEVICE AND PROCESS FOR PRODUCING A STEEL STRIP

FIELD OF THE INVENTION

The invention relates to a device for producing a thin steel strip, comprising at least one or more continuous-casting machines for casting thin steel slabs, a furnace device which is suitable for heating and/or homogenizing a slab, and at least one rolling device for reducing the thickness of a slab which is conveyed out of the furnace device.

The invention also relates to a process for producing a steel strip, in which liquid steel is cast in at least one continuous-casting machine to form a slab and, utilizing the casting heat, is conveyed through a furnace device and, in a rolling device, is rolled to form the strip with a desired final thickness.

BACKGROUND OF THE INVENTION

A device of this nature is described in application WO-A-97/46332. By this reference, the contents of this application are deemed to be incorporated into the present application. The said application proposes, inter alia, to use a device of this nature for an endless rolling process. In the said application, an endless rolling process is understood to mean a rolling process in which slabs or, following passage through a preliminary rolling device, strips are coupled together so that an endless rolling process can be carried out in a finishing mill.

In the past, it has been proposed to couple slabs together by providing the end of one slab with a shape which is such that it can be coupled to the front edge of a following slab which is also provided with a suitable, often complementary, shape. The devices which are required to do this are highly complicated and take up considerable amounts of space. In addition, the slabs which are to be coupled together are exposed to the atmosphere for a considerable length of time, with the result that the slabs cool down and a layer of oxide is formed on the slabs.

An endless rolling process, in particular when applied to thin-cast slabs, i.e. slabs with a thickness of 100 mm or less, preferably 80 mm or less, provides the possibility of achieving a very high level of temperature homogeneity during rolling. This advantage is to a considerable extent negated by a complicated coupling method as described above.

SUMMARY OF THE INVENTION

The object of the invention is to provide a device which makes it possible to couple together thin-cast slabs, which have optionally been reduced preliminary, quickly and easily. This object is achieved by means of a device which is characterized in that a welding machine is arranged between the continuous-casting machine or continuous-casting machines and the rolling device, for joining slabs together.

With a welding machine, it is possible to quickly join together end faces, which are straight or have some other simple shape, of two slabs which are to be coupled to one another. A welding machine does not take up much space, so that the slabs which are to be joined together are only exposed to the atmosphere for a short time and therefore also only emit heat to the environment during a short time. Consequently, the use of a welding machine also contributes to reducing the amount of oxide which is formed on the surface of the slabs which are welded together.

In order to avoid interim stores, for example in the form of a coil box, a preferred embodiment of the device according to the invention is characterized in that the welding machine is displaceable along a welding length in the standard passage direction of the slabs through the device towards the rolling device. By allowing the welding machine to move along with the slabs which are to be welded together, the slab, whether or not it has been reduced in size, and the strip can run at the same speed throughout the device, taking into account the reduction in thickness.

A further embodiment of the device according to the invention is characterized in that the welding machine is displaceable in the standard passage direction of the slabs through the device towards the rolling device at a speed of between 4 and 20 m/min, preferably at a speed of between 10 and 17 m/min. In an endless rolling process, the speed at which the slab enters the rolling device is, depending on the final strip thickness which is to be achieved and on whether this final thickness is reached in the austenitic, ferritic or austenitic-ferritic mixed field, in the range between 4 and 20 m/min, more preferably in the range between 10 and 17 m/min. For the process to operate efficiently, the speed at which the welding machine is displaced is preferably equal to the speed, if appropriate taking into account a reduction in thickness, at which the slab is introduced into the rolling device.

A further embodiment is characterized in that the welding machine is an induction-welding machine. This prevents the need to introduce into the weld a welding material with a chemical composition which differs from the chemical composition of the slabs which are to be welded together. This is particularly important for low-alloyed steel grades, in particular IF steel grades. In addition, the output of an induction-welding machine is easy to control.

The transfer of heat from the slabs which have been welded together to the atmosphere is limited further by an embodiment of the device according to the invention which is characterized in that the welding machine is provided with means for limiting the transfer of heat from the slabs to the environment.

It has been found that, using slab thicknesses and rolling speeds which occur in practice, the process can be operated with success, even using multi-strand continuous-casting machines, with a furnace device which is characterized in that the total length of the furnace device is between 250 and 330 m.

The slabs which are to be welded together are moved into a desired position with respect to one another using positioning means, after which the slabs are welded together by means of the welding machine, because the positioning means and the movable welding machine cannot be fully accommodated in a furnace and it is inevitable that during welding the slabs which are to be welded together will cool down in the area of the weld. In order to produce the desired temperature homogeneity of the slabs, a further embodiment of the device according to the invention is characterized in that the furnace device comprises a first zone and a second zone which, as seen in the standard passage direction, are positioned one behind the other, and the welding machine is arranged between the first and the second zones. The furnace device preferably has means for conveying through slabs at an accelerated speed in order to be able to empty the furnace device quickly following an interruption to the process, whether planned or not, and before another interruption occurs.

It has been found that a good weld, with little cooling of the slabs, can be obtained in an embodiment of the device according to the invention which is characterized in that the first zone and the second zone are positioned at a distance apart which, measured in the standard passage direction, is 4–25 m, preferably 5–17 m. In order to return the slabs which have cooled down during the welding to the correct temperature, a second zone is positioned downstream of the welding machine, as seen in the standard passage direction, which second zone, according to the invention, is characterized in that it has a length of between 25 and 100 m. It has been found that, depending on the rate at which welding can be carried out and the welding length, sufficient temperature homogenization can be achieved with such a length.

In the second zone, the welded slab is to reach a temperature homogeneity which is desired for the subsequent rolling process. It has been found that a good level of homogeneity is achieved within the available time and length of the second zone in an embodiment of the device according to the invention which is characterized in that the second zone comprises a reheat-up section and a heat-through section. In order to minimize cooling during the welding process in which the slabs which are to be welded together are exposed to the environment, it is preferable that means for limiting the transfer of heat from the slabs to the environment to be arranged in the device, between the first zone and the second zone.

Current continuous-casting machines which are used in practice for casting thin slabs have a casting speed of approx. 6 m/min for a slab thickness of between 50 and 100 mm. For an endless rolling process, it is desirable for the speed at which the slab enters the rolling device to lie in the range between approx. 10 and approx. 20 m/min, preferably in the range between 12 and 16 m/min. In order to bridge the discrepancy between casting speed and desired speed of entry, it is proposed to use a multi-strand casting machine or a plurality of casting machines next to one another. In this case, it is preferable for the device to be provided with a second furnace device for accommodating a slab. In this case, there is a dedicated furnace device available for each casting machine or for each strand, and there is no need to include complicated transverse or longitudinal conveyor means for slabs in a furnace.

Currently, there are installations in use in which the abovementioned difference in speed between casting speed and speed of entry into the rolling device arises. This difference in speed may also arise in new installations or installations which are to be newly constructed, for example in cases in which, for whatever reason, a single casting machine or a single-strand casting machine is initially used. In the event of a new continuous-casting machine being subsequently installed or a second strand being added, it is preferable for at least one of the furnace device and the second furnace device to be provided with conveyor means for conveying a slab from the second furnace device to the furnace device.

In this case, the existing installation can be retained and a second furnace device is positioned in line with the new continuous-casting machine or the second strand. The conveyor means can be used to convey slabs from the second furnace device to the furnace device, after which they can be coupled together in the welding machine.

In connection with the limited space required, which is particularly important in a multi-strand casting machine, it is preferable for the conveyor means to comprise a so-called parallel ferry. An alternative is a swivel ferry, in which a slab section from the second furnace device is placed on the swivel ferry, the rear side of which is then rotated in the direction of the furnace device. The front side of the swivel ferry from the furnace device rotates towards the first swivel ferry mentioned, after which the slab section of one swivel ferry can be placed against the other swivel ferry. The swivel ferries then rotate back to their original positions. Advantages are simple connections to the media. A drawback is the increased amount of space which is required compared to a parallel ferry.

It has been found that rapid and successful temperature homogenization is achieved in an embodiment of the second furnace device which is characterized in that the second furnace device is provided with a second heat-up section and a second heat-through section, positioned downstream of the second heat-up section, as seen in the standard passage direction of the slabs.

In order to achieve rapid and successful temperature homogenization in the furnace device too, it is preferable for the furnace device to be provided with a first heat-up section and a first heat-through section, positioned downstream of the first heat-up section, on the entry side of the furnace device, as seen in the standard passage direction of the slabs.

In connection with achieving flexibility in the operation of the furnace device, inter alia in the event of or after a planned or chance interruption, it is preferable for the furnace device to be provided at the end, as seen in the standard passage direction, with a further heat-through section which is arranged downstream of the conveyor means, if present, and upstream of the welding machine.

The invention is also embodied by a process for producing a steel strip, in which liquid steel is cast in at least one continuous-casting machine to form a slab and, utilizing the casting heat, is conveyed through a furnace device and, in a rolling device, is rolled to form the strip with a desired final thickness. This process is also described in application PCT/NL97/00325. This application describes an endless process for producing a steel strip which has been rolled in the austenitic, ferritic or in the austenitic-ferritic mixed range. The process described provides a large number of advantages. One advantage for the ability to carry out the process is that individual slabs can be coupled together. The object of the invention is to provide a process for coupling slabs in such a manner that the process described can be carried out advantageously. This object is achieved by means of a process for coupling together slabs which is characterized in that slabs, which have optionally already been prereduced, are joined together by means of welding and slabs which have been welded together are rolled in an endless process in the rolling device. Coupling slabs by means of welding provides the advantage that the slabs can be quickly joined together without the formation of inhomogeneities in the chemical composition of the steel slab obtained.

In general, it will be necessary to carry out the welding on hot slabs which are temporarily outside the furnace device. Consequently, the slabs will inevitably cool down, during welding, at the location of the weld which is to be formed. In order to prevent temperature inhomogeneities occurring in the endless rolling process, a further embodiment of the process according to the invention is characterized in that the slabs, after they have been welded together, are temperature-homogenized at least at the location of the weld joint.

In the case of an endless rolling process, it is desirable for the steel to enter the rolling device at a relatively high speed. Present continuous-casting machines are unable to achieve a casting speed which corresponds to the desired speed of entry, if appropriate taking into account the reduction in thickness. Therefore, preference is given to a process according to the invention which is characterized in that slabs from two continuous-casting machines are welded together. With the aid of two or more continuous-casting machines it is possible to achieve a flow of slab material which is sufficiently great to be able to achieve the desired speed of entry into the rolling device.

An alternative which takes up less space and is easier to realize in particular in the case of new installations is characterized in that slabs from a multi-strand continuous-casting machine are welded together.

In the event that a plurality of continuous-casting machines or a multi-strand continuous-casting machine is used, it is advantageous for a plurality of furnace devices to be used simultaneously and for slabs from the furnace devices to be coupled together using the welding machine. In this case, a dedicated furnace device is available for each strand. The slabs from the furnace devices can be placed together, optionally in one of the furnaces, and then coupled to one another by means of welding.

When carrying out an endless rolling process, a large number of installation parts are coupled together by means of the steel slab or steel strip. An interruption at one of the installation parts means that the entire device, or a large part of the device, has to be shut down. This interruption may be unplanned or planned, for example in order to change rollers. In order to be able to cope with interruptions of whatever type, a further design of the process according to the invention is characterized in that the furnace device is used as a buffer space for the temporary storage of slabs in the event of interruption to one of the parts of the installation for processing slabs which have been welded together. The furnace device can act as a buffer both for interruptions to parts which are situated upstream and for interruptions to parts which are situated downstream. The longer the furnace device, the greater the buffer capacity will be.

BRIEF DESCRIPTION OF THE DRAWINGS

The invention will be explained below with reference to the drawing, which illustrates a non-limiting embodiment of the invention.

In the drawing.

DETAILED DESCRIPTION OF THE PREFERRED EMBODIMENTS

Figure 1:
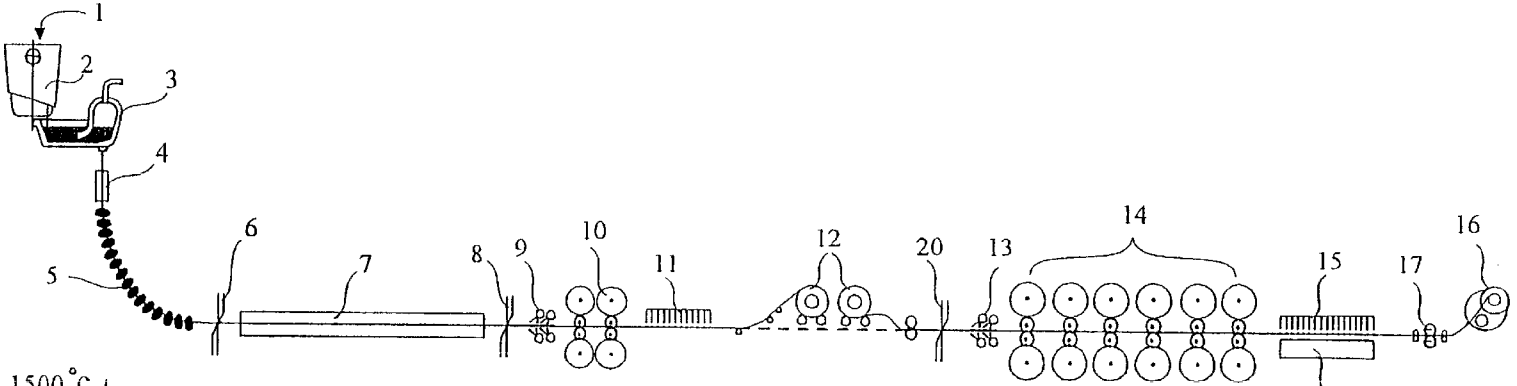
FIG. 1 shows a diagrammatic side view of a device in which the invention can be used.

In FIG. 1, reference numeral 1 indicates a continuous-casting machine for casting thin slabs. In this introductory description, this term is understood to mean a continuous-casting machine for casting thin slabs of steel with a thickness of less than 150 mm, preferably less than 100 mm, more preferably less than 80 mm. The continuous-casting machine may comprise one or more strands. It is also possible for a plurality of continuous-casting machines to be positioned next to one another. These embodiments fall within the scope of the invention. Reference numeral 2 indicates a casting ladle from which the liquid steel which is to be cast is fed to a tundish 3. Beneath the tundish 3, there is a casting mould 4 into which the liquid steel is cast and at least partially solidified. The standard continuous-casting machine has a casting speed of approx. 6 m/min. The solidified thin slab is introduced into a furnace device, for example in the form of a tunnel furnace 7, which has a total length of, for example, approx. 300 m. The design of the tunnel furnace will be described below. Using the shearing device 6, the slab can be top-and-tailed and a slab can be cut into sections which are manageable in connection with the design of the furnace device or furnace devices and the operation thereof. The speed at which the slab enters the furnace corresponds to the casting speed and is therefore approx. 0.1 m/sec. Downstream of furnace 7, there is an oxide-removal device 9 for blasting off the oxide which has formed on the surface of the slab. The rolling device 10, which fulfils the function of the preliminary rolling device, comprises two four-high stands. If desired, a shearing device 8 may be included for emergency situations.

Figure 2:
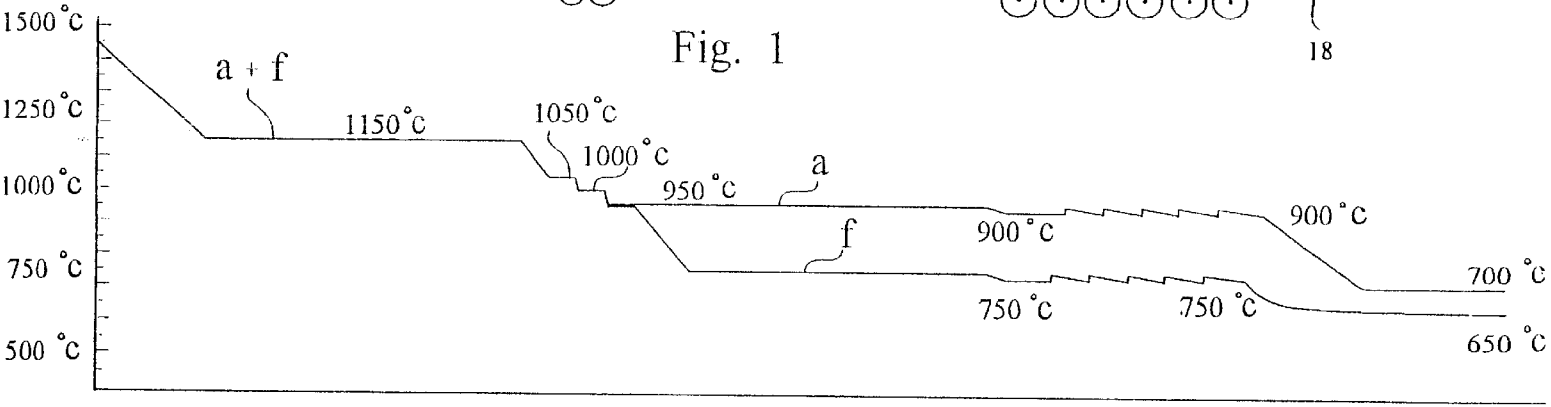
FIG. 2 shows a graph illustrating the temperature profile in the steel as a function of the position in the device.
Figure 3:
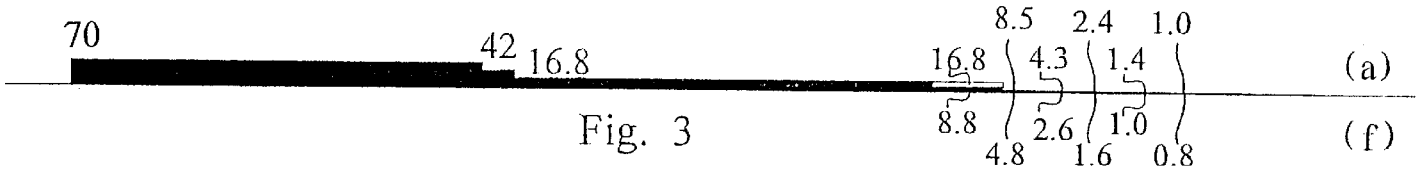
FIG. 3 shows a graph illustrating the thickness profile of the steel as a function of the position in the device.

It can be seen from FIG. 2 that the temperature of the steel slab, which is approximately 1450° C. on leaving the tundish, falls in the rolling stand to a level of approx. 1150° C., and the slab is homogenized in the furnace device at that temperature. The intensive spraying with water in the oxide-removal device 9 causes the temperature of the slab to fall from approximately 1150° C. to approximately 1050° C. This applies for rolling both in the austenitic and in the ferritic fields, a and f respectively. In the two rolling mill stands of the preliminary rolling device 10, the temperature of the slab falls, with each roller increment, by another approximately 50° C., so that the slab, the thickness of which was originally approximately 70 mm and which is formed in two steps, with an interim thickness of 42 mm, into a steel strip with a thickness of approx. 16.8 mm, is at a temperature of approximately 950° C. The thickness profile as a function of the location is shown in FIG. 3. The numbers indicate the thickness in mm. A cooling device 11, a set of coil boxes 12 and, if desired, an additional furnace device (not shown) are accommodated downstream of the preliminary rolling device 10. During the production of an austenitically rolled strip, the strip emerging from the rolling device 10 may be temporarily stored and homogenized in the coil boxes 12, and if an additional increase in temperature is required, may be heated in the heating device (not shown) which is positioned downstream of the coil box. It will be obvious to the person skilled in the art that cooling device 11, coil boxes 12 and the furnace device which is not shown may be in different positions with respect to one another from those mentioned above. As a result of the reduction in thickness, the rolled strip enters the coil boxes at a speed of approx. 0.6 m/sec. A second oxide-removal installation 13 is positioned downstream of the cooling device 11, coil boxes 12 or furnace device (not shown), for the purpose of again removing an oxide skin which may have formed on the surface of the rolled strip. If desired, another shearing device may be included so as to head and tail a strip. The strip is then introduced into a rolling train which may be in the form of six four-high rolling mill stands which are positioned one behind the other.

When producing an austenitic strip, it is possible to achieve the desired final thickness of between, for example, 1.0 and 0.6 mm by using only five rolling mill stands. The thickness which is achieved by each rolling mill stand is indicated, for a slab thickness of 70 mm, in the top row of figures in FIG. 3. After leaving the rolling train 14, the strip, which is then at a final temperature of approximately 900° C. and has a thickness of 0.6 mm, is intensively cooled by means of a cooling device 15 and is coiled onto a coiling device 16. The speed at which it enters the coiling device is approx. 13–25 m/sec.

If a ferritically rolled steel strip is to be produced, the steel strip emerging from the preliminary rolling device 10 is intensively cooled by means of cooling device 11. This cooling device may also be incorporated between rolling stands of the final rolling device. It is also possible to employ natural cooling, optionally between rolling stands. Then, the strip spans coil boxes 12 and, if desired, the furnace device (not shown), and oxide is then removed in oxide-removal installation 13. The strip, which is by now in the ferritic field, is then at a temperature of approximately 750° C. As stated above, a further part of the material may still be austenitic but, depending on the carbon content and the desired final quality, this may be acceptable. In order to provide the ferritic strip with the desired final thickness of between, for example, 0.8 and 0.5 mm, all six stands of the rolling train 14 are used.

As in the situation where an austenitic strip was being rolled, for rolling a ferritic strip an essentially equal reduction in thickness is used for each rolling mill stand, with the exception of the reduction carried out by the final rolling mill stand. All this is illustrated in the temperature profile in accordance with FIG. 2 and the thickness profile in accordance with the bottom row of FIG. 3 for ferritic rolling of the steel strip as a function of the position. The temperature profile shows that the strip, on emerging, is at a temperature which is well above the recrystallization temperature. Therefore, in order to prevent the formation of oxide, it may be desirable to use a cooling device 15 to cool the strip to the desired coiling temperature, at which recrystallization may still take place. If the exit temperature from rolling train 14 is too low, it is possible to bring the ferritically rolled strip up to a desired coiling temperature by means of a furnace device 18 which is positioned downstream of the rolling train. Cooling device 15 and furnace device 18 may be positioned next to one another or one behind the other. It is also possible to replace one device with the other device depending on whether ferritic or austenitic strip is being produced. As has already been mentioned, rolling is carried out endlessly or semi-endlessly when producing a ferritic or austenitic strip. This means that the strip emerging from the rolling device 14 and, if appropriate, cooling device or furnace device 15 or 18, respectively, has a greater length than is usual for forming a single coil and that a slab section with the length of a complete furnace, or even a longer slab section, is rolled continuously in the final rolling device. A shearing device 17 is included in order to cut the strip to the desired length, corresponding to standard coil dimensions. If desired, an additional so-called closed coiler may be accommodated immediately downstream of the rolling train 14 in order to assist with controlling the strip movement and the strip temperature. The device is suitable for strips with a width of between 1000 and 1500 mm and a thickness of approximately 1.0 mm in the case of an austenitically rolled strip and of approximately 0.5 to 0.6 mm in the case of a ferritically rolled strip.

Figure 4:
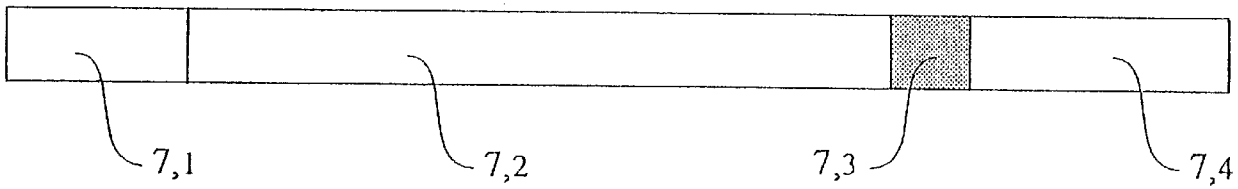
FIG. 4 shows a more detailed embodiment of the furnace device with welding machine.

FIG. 4 shows a more detailed embodiment of a furnace device with welding machine which forms part of the furnace device. The furnace device comprises a first zone, comprising the parts 7,1 and 7,2 and a second zone 7,4. A welding machine 7,3 is positioned between the first zone and the second zone. The first zone is composed of a first heat-up section 7,1 and a first heat-through section 7,2. The length of the first heat-up section 7,1 corresponds to approximately the length of a slab section. As soon as a slab section is completely accommodated in the first heat-up section 7,1, the slab section is with speed-up conveyed through to the heat-through section 7,2. A number of slab sections may be buffered inside the heat-through section 7,2, on the one hand in order to have sufficient time for heating them thoroughly, and on the other hand as a buffer in the event of a part of the installation, downstream or upstream of the furnace device, being out of operation owing to planned or unplanned interruption. A second zone 7,4 is positioned downstream of the welding machine 7,3, in which second zone slab sections which have been welded together are homogenized in order to even out the temperature drop which has occurred during welding at the location of the weld. The total length of the furnace is 250–320 m. The length of the first heat-up section 7,1 is approx. 35 to 70 m. The length of the first heat-through section 7,2 is approx. 100–150 m. The length required for the welding machine 7,3 is approx. 4–25 m, and the length of the second zone 7,4 is approx. 50–80 m.

Figure 5:
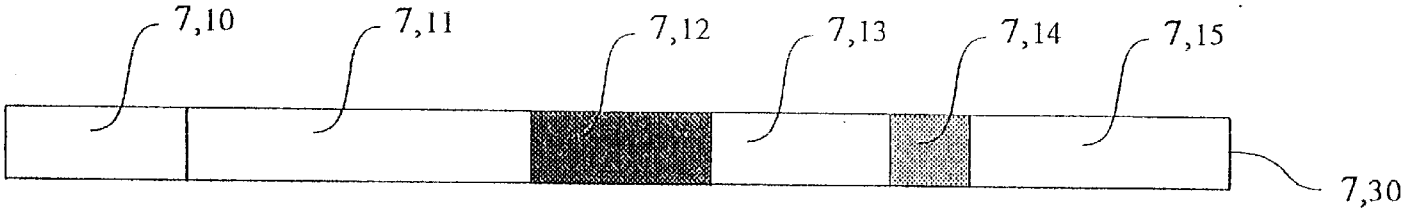
FIG. 5 shows a more detailed embodiment of a device with a plurality of furnace devices which are used simultaneously for a plurality of strands.
Figure 5:
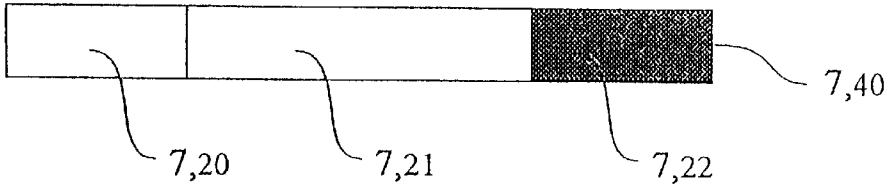

FIG. 5 shows a more detailed breakdown of an arrangement with a plurality of furnace devices which can be used simultaneously for a plurality of strands. Furnace device 7,30 comprises a first heat-up section 7,10, a first heat-through section 7,11 and a parallel ferry 7,12. A further heat-through section 7,13 is positioned downstream of parallel ferry 7,12. Downstream of 7,13 there is a welding machine 7,14 which is followed by a second zone 7,15 for the homogenization of slabs which have been welded together. The second furnace device 7,40 comprises a second heat-up section 7,20, a second heat-through section 7,21 and a parallel ferry 7,22. With the aid of the parallel ferries 7,12 and 7,22, slab sections can be conveyed from furnace 7,40 to furnace 7,30 and, with the aid of welding machine 7,14, can be coupled to slabs which have been supplied to furnace 7,30 directly from a continuous-casting machine. When conveying a slab section, parallel ferry 7,22 moves parallel to its longitudinal direction, towards parallel ferry 7,12, which temporarily moves out of its normal position. After parallel ferry 7,22 has taken up the position of parallel ferry 7,12, the conveyed slab section is pushed through towards the further heat-through section 7,13, after which both parallel ferries return to their original position.

Table 1 shows an overview of possible configurations of the furnaces 7,30 and 7,40. In configuration 1, the furnace has a buffer length of 208 m which, in the event of an interruption involving a reduction in casting speed of 0, 25 and 50% compared to a casting speed of 6 m/min, provides a buffer capacity, in minutes, of 20, 26 and 39 minutes, respectively. This buffer time is available for eliminating interruptions to the device. With a buffer length of 180 m, as is achieved in the configurations 2 and 3, the respective buffer times are 14, 18 and 27 minutes, and in configuration 4 the buffer times are respectively 8, 10 and 14 minutes. It is advantageous to position the parallel ferry as far as possible towards the front in order to be able to keep the length of the furnace devices 7,30 and 7,40 short.

TABLE 1

| Configurations: | 1 | 2 | 3 | 4 |
|---|---|---|---|---|
| -length of first or second heat-up section furnace 7,10 and 7,20 | a 50 m | 50 m | 50 m | 50 m |
| -length of first or second heat-through section 7,11 and 7,21 | b 124 m | 96 m | 96 m | 70 m |
| -length of 7,12 and 7,22 | c 42 m | 42 m | 42 m | 42 m |
| -length of heat-through section rear 7,13 | d 42 m | 42 m | 42 m | 42 m |
| -length of welding section 7,14 | 52 m | 80 m | 52 m | 106 m |
| Total = | 310 m | 310 m | 282 m | 310 m |
| -buffer length (b + c + d) | 208 m | 180 m | 180 m | 154 m |
| -position of parallel ferry (a + b) | 174 m | 146 m | 146 m | 120 m |
| -length of furnace 7,40 (a + b + c) | 216 m | 188 m | 188 m | 162 m |

Figure 6:
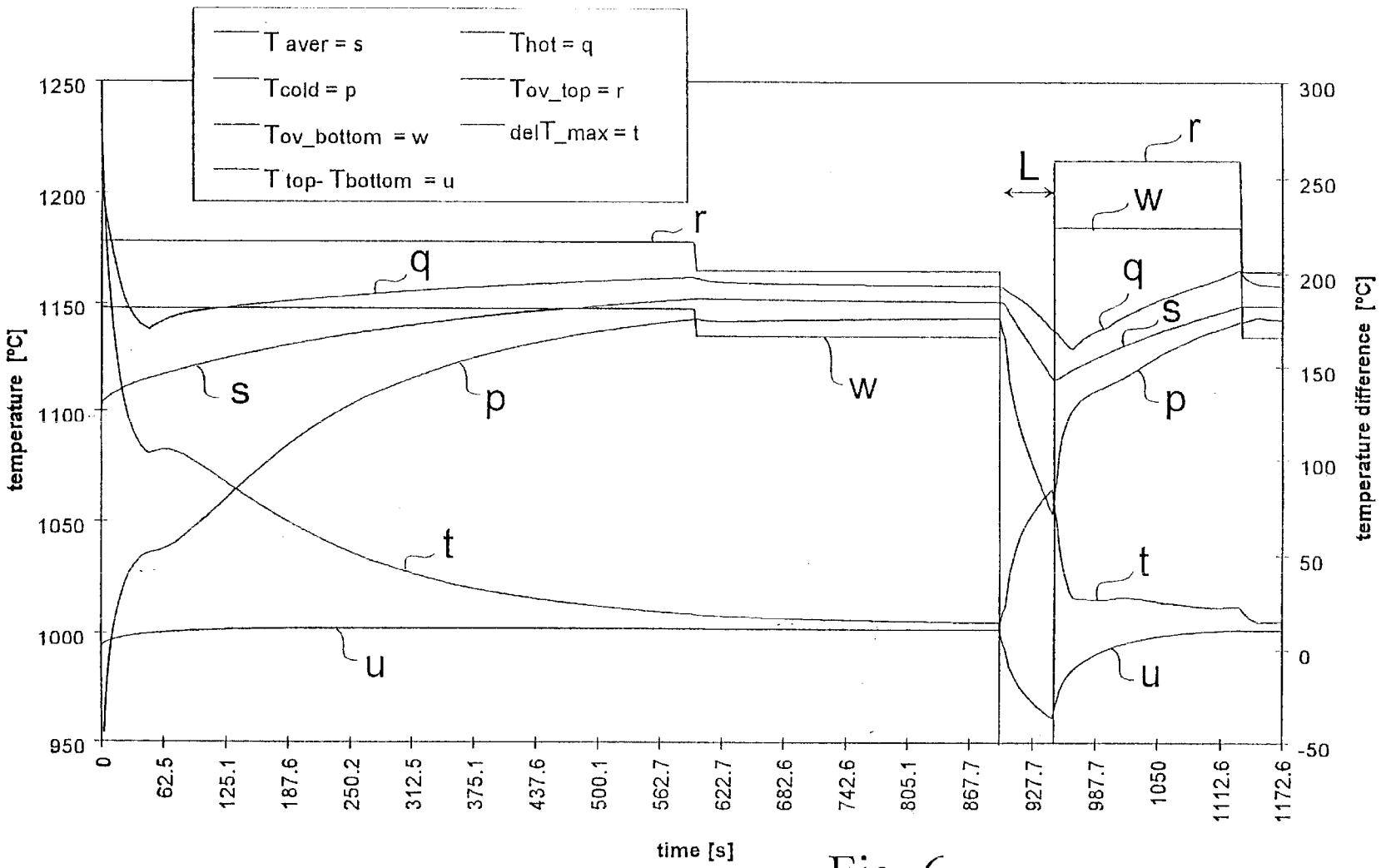
FIG. 6 shows the profile of the temperature and the temperature difference for various points of the slab and the furnace as a function of time.

FIG. 6 shows the profile of the temperature and the temperature difference for various points of the slab as a finction of time. The curves apply to a length of the first heat-up section after casting of 60 m, a welding length of 10 m, a length of the second zone after welding of 45 m, and a total furnace length of 280 m. It can be seen from the profile of the curves p (lowest temperature of the slab) and q (highest temperature of the slab) that a temperature homogenization takes place. The profile with which this takes place can be seen from the profile of curve t. The curve u shows the temperature difference between the top side and the underside of the slab. Curves w and r respectively indicate the temperature in the bottom and top of the furnace device. Curve s shows the average slab temperature through the cross section. It can clearly be seen that in the period indicated by L, during which the welding takes place, temperature inhomogenization occurs and is then evened out again in the second zone, which lies downstream of the welding machine, until an acceptable temperature difference of approx. 10° between the coldest and hottest sections of the slab is reached before the slab is introduced into the rolling device.

What is claimed is:

1. A device for producing a thin steel strip, comprising:

at least one continuous casting machine (1) for casting steel slabs with a thickness of <120 mm, a furnace device (7) which is suitable for heating and/or homogenizing a slab, at least one rolling device (10) for reducing the thickness of a slab which is conveyed out of the furnace device (7), a welding machine (7,3) arranged between the continuous-casting machine (1) or continuous-casting machines and the rolling device (10), for melting of narrow end faces of the slabs and then joining together successive slabs, the welding machine (7,3) being displaceable in the standard passage direction of the slabs through the device for producing a thin steel strip towards the rolling device (10), and the furnace device (7) comprising a first zone and a second zone which, seen in the standard passage direction, are positioned one zone after the other zone, and the welding machine being arranged between the first zone and the second zone.

2. The device according to claim 1, wherein the welding machine (7,3) is displaceable in the standard passage direction of the slabs through the device for producing the thin steel strip towards the rolling device at a speed of between 4 and 20 m/min.

3. The device according to claim 1, wherein the welding machine (7,3) is an induction-welding machine.

4. The device according to claim 1, wherein the welding machine (7,3) is provided with means for limiting the transfer of heat from the slabs to the environment.

5. The device according to claim 1, wherein the total length of the furnace device (7) is between 250 and 330 m.

6. The device according to claim 5, wherein the first zone and the second zone are positioned at a distance apart which, measured in the standard passage direction, is 4–25 m.

7. The device according to claim 5, wherein the second zone has a length of between 25 and 100 m.

8. The device according to claim 5, wherein the second zone comprises a reheat-up section and a heat-through section.

9. The device according to claim 5, wherein a means for limiting the transfer of heat from the slabs to the environment are arranged between the first zone and the second zone.

10. The device according to claim 1, wherein the first zone and the second zone are positioned at a distance apart which, measured in the standard passage direction, is 5–17 m.

11. The device according to claim 1, wherein the device is provided with a second furnace device for accommodating a slab.

12. The device according to claim 11, wherein at least one of the first furnace device and the second furnace device is provided with conveyor means for conveying a slab from the second furnace device to the first furnace device.

13. The device according to claim 12, wherein the conveyor means comprise a parallel ferry.

14. The device according to claim 11, wherein the second furnace device is provided with a second heat-up section and a second heat-through section, positioned downstream of the second heat-up section, as seen in the standard passage direction of the slabs.

15. The device according to claim 11, wherein the furnace device (7) is provided at the end, as seen in the standard passage direction, with a further heat-through section which is arranged downstream of the conveyor means and upstream of the welding machine.

16. The device according to claim 1, wherein the furnace device (7) is provided with a first heat-up section and a first heat-through section, positioned downstream of the first heat-up section, on the entry side of the furnace device (7), as seen in the standard passage direction of the slabs.

17. The device according to claim 1, wherein the welding machine (7,3) is displaceable in the standard passage direction of the slabs through the device for producing the thin steel strip towards the rolling device at a speed of between 10 and 17 m/min.

18. The device according to claim 1, wherein the furnace device (7) is provided at the end, as seen in the standard passage direction, with a further heat-through section which is arranged upstream of the welding machine.

19. A process for producing a steel strip in a device for producing a thin steel strip comprising at least one continuous-casting machine, a furnace device, at least one rolling device, and a welding machine, comprising the steps of:

casting liquid steel in the at least one continuous-casing machine to form a slab with a thickness of <120 mm, conveying the slab utilizing the casting heat, through the furnace device, joining together successive slabs by fusing mutually facing narrow end faces by welding in the welding machine arranged between the continuous-casting machine or continuous-casting machines and the rolling device, the welding machine being displaceable in the standard passage direction of the slabs through the device for producing a thin steel strip towards the rolling device, and the furnace device comprising a first zone and a second zone which, seen in the standard passage direction, are positioned one zone after the other zone, and the welding machine being arranged between the first zone and the second zone;

rolling slabs which have been welded together in an endless process in the rolling device, and temperature-homogenizing the slabs, after they have been welded together, at least at the location of the weld joint.

20. The process according to claim 19, wherein slabs from two continuous-casting machines (1) are welded together.

21. The process according to claim 19, wherein slabs from a multi-strand continuous-casting machine are welded together.

22. The process according to claim 19, wherein a plurality of furnace devices (7) are used simultaneously and slabs from the furnace devices are coupled together using the welding machine.

23. The process according to claim 19, wherein the furnace device is used as a buffer space for the temporary storage of slabs in the event of interruption to one of the parts of the installation for processing slabs which have been welded together.

24. The process of claim 19, further comprising reducing the slab in size prior to the welding.

* * * * *